United States Patent [19]

Mazzucato et al.

[11] 4,223,622

[45] Sep. 23, 1980

[54] TANKER DESLUDGING SYSTEM

[75] Inventors: Fabio Mazzucato, Bibione; Roberto Tenti, Savona, both of Italy

[73] Assignee: Texaco Inc., White Plains, N.Y.

[21] Appl. No.: 844,955

[22] Filed: Oct. 25, 1977

Related U.S. Application Data

[63] Continuation-in-part of Ser. No. 727,726, Sep. 29, 1976, abandoned.

[51] Int. Cl.[2] ..... B63B 25/08

[52] U.S. Cl. ..... 114/74 R; 15/338

[58] Field of Search ..... 114/73, 74 R, 74 T, 114/269, 270; 214/14, 15 R; 417/61; 15/1.7, 246.5, 327 R, 327 C, 330, 337, 338; 210/73 R, 56

[56] References Cited

U.S. PATENT DOCUMENTS

| | | | |
|---|---|---|---|
| 1,920,621 | 8/1933 | Allen | 15/338 |
| 2,443,721 | 6/1948 | Butcher, Jr. | 114/74R |
| 3,253,746 | 5/1966 | Vreedenburgh | 114/74 R |
| 3,407,430 | 10/1968 | Renner | 15/1.7 |
| 3,940,827 | 3/1976 | Greco | 15/338 |

*Primary Examiner*—Jesus D. Sotelo

*Attorney, Agent, or Firm*—Carl G. Ries; Robert B. Burns

[57] ABSTRACT

In a marine vessel adapted to carry liquids such as crude oil which embodies a certain amount of solid residue, apparatus is provided for removing the latter from the vessel's storage tanks. The liquid crude is normally removed by a manifolded discharge or eductor system communicated with the suction side of a pump. The eductor system includes a plurality of individually controlled open ended discharge conduits, each conduit being fixedly positioned with its inlet port spaced above the floor of the tank to withdraw liquid from the tank. A portable cleaning apparatus is provided to remove accumulated sludge and the like from the tank floor, which cleaning apparatus is adapted to removably engage a discharge conduit whereby to ingest sludge from the latter.

3 Claims, 7 Drawing Figures

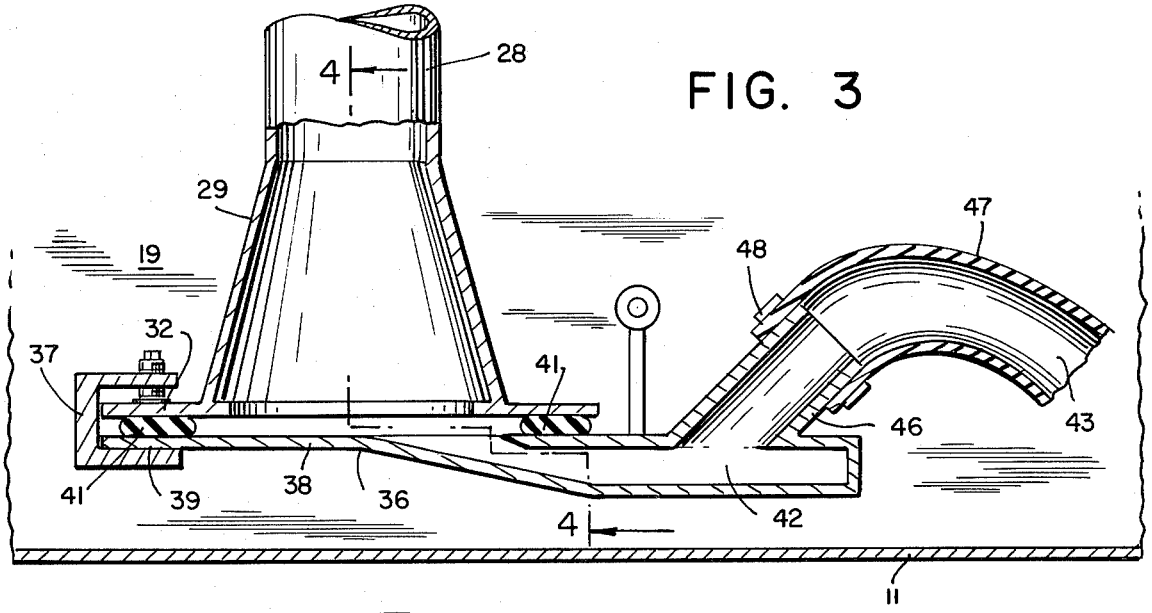
FIG. 3
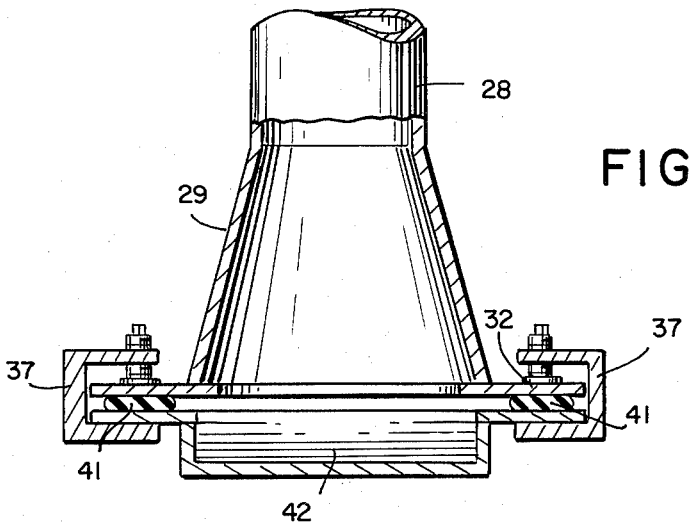
FIG. 4
FIG. 5
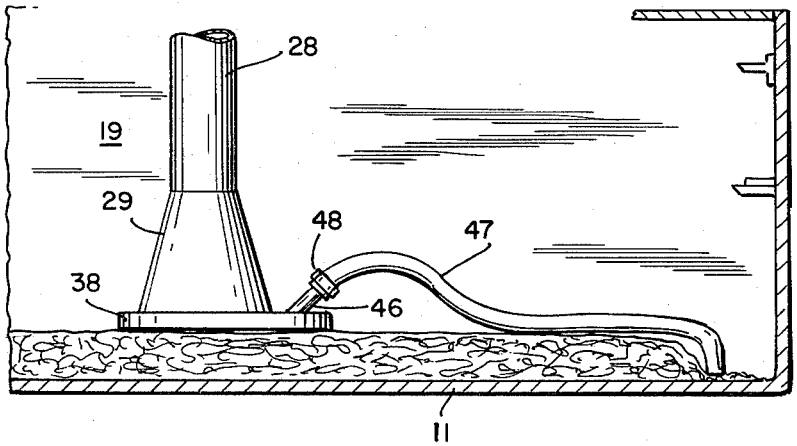

TANKER DESLUDGING SYSTEM

This is a continuation-in-part of our application Ser. No. 727,726, filed on Sept. 29, 1976, now abandoned.

BACKGROUND OF THE INVENTION

A large part of the world's oil supplies are carried to and from the various ports and terminals by tankers and similar vessels. The latter are built in all sizes depending on the use to which they are put and the waters through which they will operate. It has, however, become economically desirable to make the tankers sufficiently large to carry increasingly larger cargos. The latter are referred to as very large cargo carriers.

As a matter of practicality all tanker hulls are segregated into a plurality of individual tanks. These tanks are connected to manifold systems which facilitate the simultaneous carrying of different liquids to and from various ports. Thus, a ship's cargo can embody at any one time a number of different liquids, whether they be in refined or crude form.

In the instance of crude oil carrying vessels, the crude liquid, as it is brought from the ground, normally carries with it considerable amounts of solids and foreign materials. This is understandable since the normal reservoir for the crude which is forced from the ground, is generally formed of either rock or clay or similar forms of substrate.

In any event even though the crude as it is received from the ground is quite flowable, it nonetheless carries with it a substantial portion of solid material. This latter will, when the crude is permitted to stand for any period of time, tend to separate or settle out from the liquid. Thus, as the solid components are normally heavier than the liquid, the solid faction will gravitate to the bottom of the storage tank and gradually accumulate to a depth of from several inches to several feet.

Further, the deposits on the tank floor will include muddy waters, rusty water, and mud.

This semisolid or highly viscous liquid mass is generally referred to as sludge. Its presence on the vessel is undesirable for several reasons. First, when the vessel's tanks are holding sludge it is undesirable to carry any refined liquid or petroleum since a certain amount of the sludge will be picked up and carried along with the refined product. Further, when the sludge is permitted to lie for a period in a closed or even a semiclosed tank it will tend to gasify and promote an explosive atmosphere within the tanks.

It is therefore standard procedure when transporting crude products over water between two points, that periodically the vessel's tanks be cleaned out. This cleaning normally removes the sludge and other solid accumulations from the floor of the tank. The cleaning further embodies a degassing process which removes any gaseous product which may have accumulated in the tank.

There are a number of known and practical ways of removing sludge such that it can either be processed, or deposited in a separate holding tank or vessel. It can thereafter be disposed of either economically, or in any manner desired to avoid pollution of the environment.

At present, tankers are equipped with various means and systems for dealing with sludge. However the most common expedient resorted to for cleaning the vessel's tanks, is by the removal of the sludge manually, using the simplest of implements. The process in any event is both time consuming and expensive.

In some instances sludge can be removed from the tanks while the vessel is in transit. Thus all the solids are deposited in a separate holding tank. Such an operation can also be achieved while the vessel is at anchor, while moored to a tug, or while in dry dock. In any event the sludge is removed by an operation that mandates considerable expense as well as loss in operating days.

In the presently disclosed invention means is provided within a tanker for transferring cargo to and from the various holding and liquid storage tanks. Toward achieving a relatively inexpensive cleaning operation, the tanker is provided with means for connecting into either the main, or into a stripper offloading system. Thus, a portable discharge unit is removably connected to any of the individual cargo ingesting connections which are located within the respective tanks. By actuating the discharge or eductor system, sludge can be readily removed from the tank and collected, or otherwise disposed of.

It is therefore an object of the invention to provide a tanker cargo discharge or offloading system that is capable of achieving an economical and quick cleaning of the vessel's tanks.

A further object is to provide a cargo discharge system for a tanker which is capable of reaching into all parts of the vessel's storage tanks to reach accumulations of sludge which ordinarily remain at the tank's floor as a viscous residue.

Still another object is to provide a portable sludge offloading apparatus capable of removably connecting to a vessel's cargo offloading system whereby activation of the latter will cause the sludge to be ingested and removed from the vessel's respective holding tanks.

DESCRIPTION OF THE DRAWINGS

FIG. 3 is an enlarged segmentary view of a portion of the hull shown in FIG. 2.

FIG. 4 is an enlarged segmentary view similar to FIG. 3.

FIG. 5 is an enlarged segmentary view in cross section of a portion of FIG. 2.

Referring to FIG. 1, a tanker or vessel 11 of the type contemplated as herein noted, can be of virtually any size and capacity. Structurally it embodies a number of tanks or compartments built into the ship's hull. The respective tanks are of course segregated one from the other to facilitate the simultaneous carrying of different liquids. During a normal liquid cargo offloading operation, the vessel can be positioned as shown at a single point mooring 12 such that the vessel is free to oscillate about the mooring in response to forces exercised by wind, tide, etc. Said mooring is restrained by anchors 14 which are embedded into the ocean floor.

Figure 1:
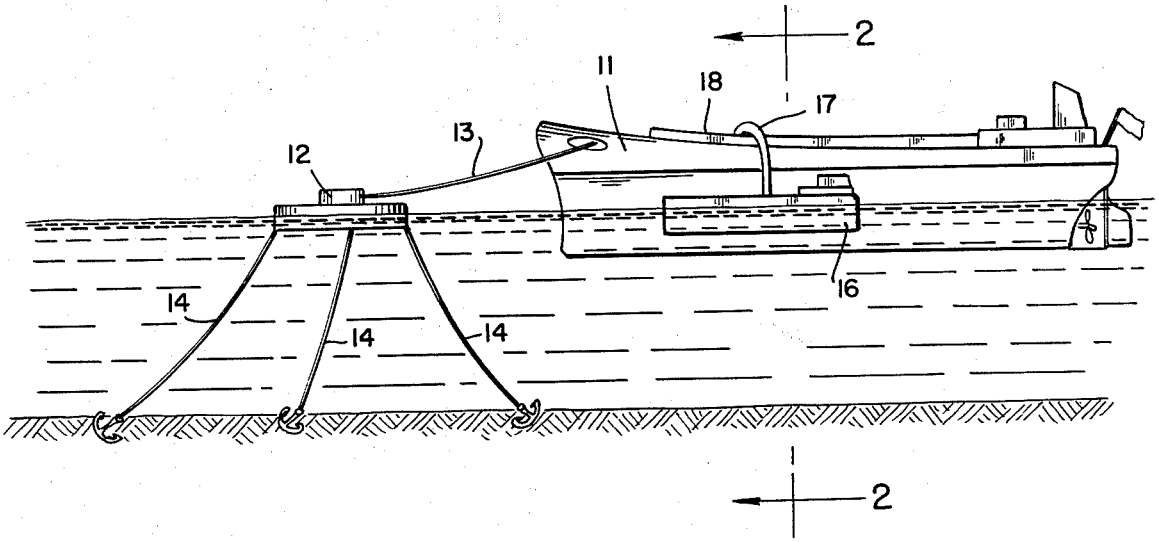
FIG. 1 is a view of a tanker of the type contemplated shown in a floating position, attached to a mooring.

Toward illustrating the invention, vessel 11 is shown as having its forward end fastened by means of a hawser or mooring line 13. An auxiliary vessel 16 is positioned adjacent to the tanker 11, being in a position to receive one or more liquid carrying conduits or hoses 17 from the latter.

It is understood that in a tank cleaning operation, the tanker 11 will be substantially empty of cargo. Thus, it will ride relatively high in the water. However, the desludging or cleaning operation will function equally as well regardless of the number of tanks within the vessel which are empty so long as the balance of the vessel is maintained. Since each of the tanks is separate and discrete they are treated individually.

The deck of tanker 11 is provided with a network of conduits, pipes, valves and the like, each adapted to the various systems for loading and offloading the vessel, whether with cargo or ballast material. These are shown generally at 18.

Normally, for any offloading operation, the appropriate system or systems are actuated. In the present arrangement, the various cargo discharge means will be referred to as the main eductor; and/or the stripper systems. In either event both systems function that liquid cargo can be pumped from vessel 11, into either the single point mooring 12 or into adjacently positioned vessel 16.

Figure 2:
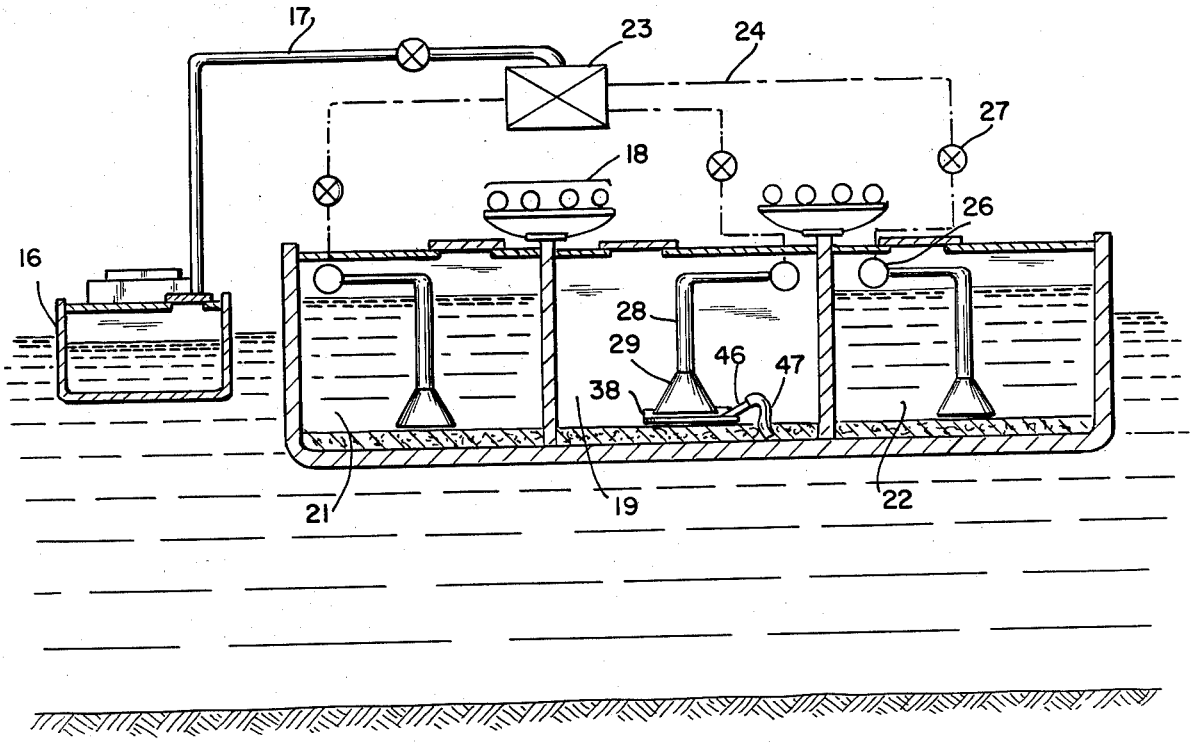
FIG. 2 is a view in cross section taken along line 2—2 in FIG. 1.

Referring to FIG. 2, tanker 11 includes a plurality of individually positioned tanks including a main or center tank 19, together with adjacently positioned wing tanks 21 and 22. Each tank as shown includes means therein for offloading cargo. It is understood that the above noted main offloading and stripper systems can be utilized for use with the present purpose. It will be assumed however for the instant description that the vessel 11 only utilizes a main eductor system so connected and actuated to remove liquid cargo from any one of the respective tanks. Also, since tankers of the type contemplated are made in various sizes the depth or draft of the vessels and consequently the heights of the tanks are commensurable with the vessel's capacity. In very large vessels, the cargo holding tanks are approximately 90 feet high.

Referring to FIG. 2, the eductor system for such a tank, 19 for example, comprises basically a main offloading system which is powered by a pumping mechanism 23. The latter can comprise one or more pumps within the vessel so arranged with the suction side connected to a manifold line 24 to draw the necessary suction on the manifold whereby to remove liquid from tank 19.

Each tank is provided with an individual branch line 26 which depends from the main eductor line. Valving means 27 positioned in each branch permits controlled regulation of the flow from the respective tanks. This feature of course permits the tanks to be offloaded at a sufficient rate, and in proper rotation to maintain the balance of the vessel in the water.

The branch line 26 from the main eductor line 24 includes a riser member 28 which extends downwardly toward the floor of tank 19 terminating in a bell-like housing 29. The lower open end of the latter is disposed substantially parallel with the floor of tank 19. Said housing is further positioned above the tank floor a predetermined distance such that it is capable of removing the bulk of the liquid contained in the tank 19 without also removing accumulated sludge.

Functionally to offload cargo, pumping system 23 is communicated through necessary valve and discharge lines 17 to the auxiliary vessel which can be a tank on shore or another vessel. A suction established within manifold line 24 will draw liquid crude oil from the desired tank or tanks which are communicated with the pumping means by opening the flow control valve 27.

The offloading operation will continue until the level of the crude oil contained within tank 19 is reduced to a point where the open end of the bell housing 29 becomes spaced from the surface of the crude and the suction is no longer able to cause the upward flow of the crude through riser 28. At such time, valve 27 to the emptied tank is closed and a second control valve to the next tank to be discharged, is open. Usually as the liquid level in a tank becomes lowered, a stripper system will be actuated to remove a further volume of the contained crude oil. However, as noted herein, although said stripper system is similar to the main eductor system the invention will be described in conjunction with the latter.

Referring to FIGS. 3 and 4, the terminus of the eductor system, i.e. the bell housing 29, is provided at its lower end with a flange 32 which extends outwardly from the housing to define the inlet port. Flange 32 is adapted to mate with a corresponding flange or lip on the portable eductor apparatus 36 to be hereinafter described. While said flange 32 as shown is so arranged to receive a plurality of clamps 37 it can also be adapted by the judicious placing of openings, to receive fastening bolts or equivalent positioning means.

The portable eductor unit as shown in FIGS. 3 and 4 includes primarily a relatively flat base plate 38 having a peripheral edge 39 which corresponds to the size and configuration of bell housing flange 32. Said peripheral plate includes means for removably accomodating the above noted clamping devices 37 or the bolts which are adjustable to draw plate 38 into tight engagement with the flange 32.

Deformable sealing means disposed between the respective flange and the plate includes a circular gasket 41 of sufficient resiliency that it will deform in response to the application of pressure as the respective flange and plate are brought into tight engagement. Said gasket 41 can be retained on the bell housing 29 but is preferably carried on the portable eductor unit 36. As a matter of convenience said gasket is positioned on the latter to avoid being damaged during a normal cargo offloading operation when the removable eductor 36 is not in place.

One end of the plate 38 is provided with an elongated chamber 42 formed below the planar margin of said plate. Said chamber defines a closed compartment communicated with the bell housing 29, and having a single intake port 43 communicated therewith.

Toward facilitating the handling of the portable eductor means 36 the latter can be provided with suitable lifting eyes so disposed that the entire unit can be manipulated from the deck of a ship.

The periphery of the bell housing 29 as noted, is provided with a series of spaced apart clamping means 37. These are arranged in the open position during the aligning of the eductor 36 and bell housing 29, and can be either manually or automatically set to close in position when the two members are properly aligned. As a matter of practice, the portable eductor 36 is lowered into position into tank 19, and guided by one or two workmen positioned at the floor of tank 19. With the eductor unit 36 properly aligned at the underside of bell housing 29, the respective clamps 37 are manually adjusted to bring the eductor and the flange into close mating position thereby compressing the gasket and forming a substantially fluid tight seal.

Figure 6:
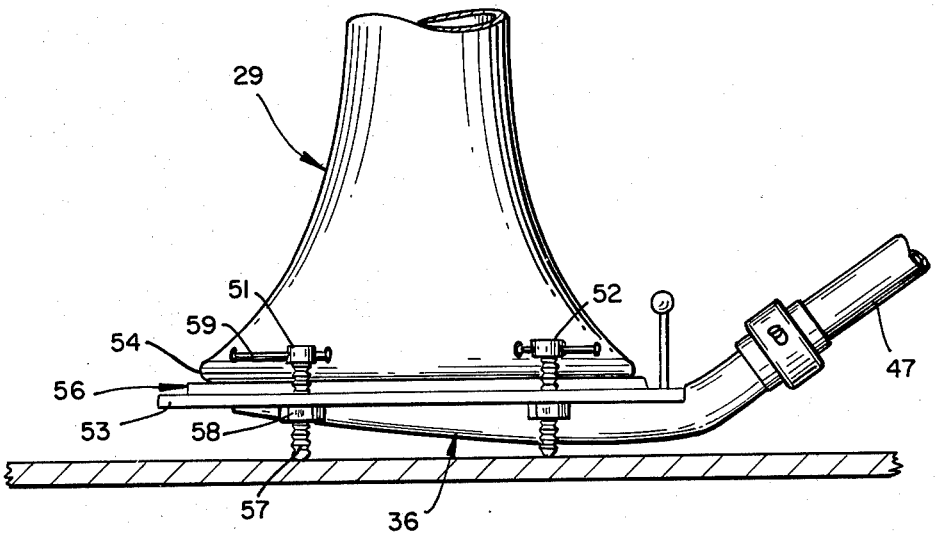
FIGS. 6 and 7 are alternate embodiments of the invention.

As illustrated in FIG. 6, in an alternate embodiment of the invention, toward facilitating the handling and manipulating of eductor 36, the latter is provided with a series of screw jacks 51 and 52. These members serve not only to support the eductor, but also to accurately raise the unit into sealing engagement with the undersurface of bell housing 29.

As shown, the respective screw jacks 51 and 52 are disposed at regular intervals about the peripheral clamping surface 53 of eductor 36. The eductor can thus be lowered from a ship's deck onto a sludge covered tank floor and laterally adjusted to be below and in alignment with the corresponding lip 54 of the bell housing. While being initially positioned, the respective screw jacks 51 and 52 are sent with the lower ends protruding below the eductor surface. Thereafter, the respective jacks can be manually adjusted as to pass through the sludge and to contact the tank floor.

With the eductor resting on the firm tank floor, progressive actuation of the respective screw jacks will raise the eductor up until gasket 56 is compressibly deformed against the eductor clamping surface to form a fluid tight peripheral seal.

Each screw jack 51 as shown, is comprised of an elongated threaded shank 57, which is rotatably positioned in a retaining boss 58 on the detector. A handle 59 at the upper end of each jack is so positioned to permit the jacks to be individually manipulated and adjusted to a down position, thereby bringing the eductor into raised sealing engagement with the bell housing.

Figure 7:
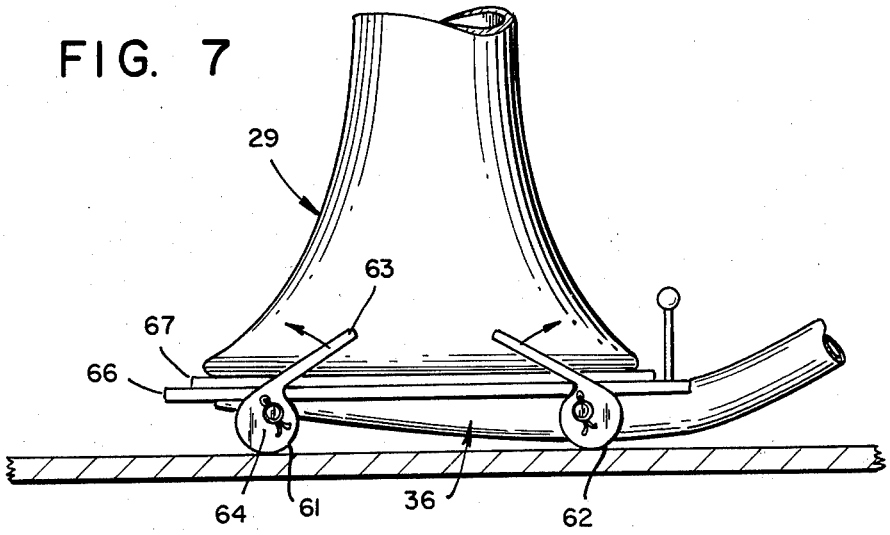

In another alternate embodiment of the invention, and as shown in FIG. 7, the eductor member is provided with a plurality of clamping and raising arms 61 and 62 disposed about the periphery of the eductor sealing lip. Said clamping arms include an elongated handle 63 which depends tangentially from a cam-like base 64. The latter is pivotally retained within a mounting hub 68 depending from the eductor sealing lip 66 such that each handle can be individually manipulated to either raise or lower the eductor as required.

Thus as the eductor is lowered into place, the respective clamping arms 61 and 62 are adjusted to bring the cam surface into contact with the floor of the tank. When thus properly aligned, the arms 61 and 62 are manually adjusted to raise the eductor into sealing engagement by compressing gasket 67 against the corresponding lip of the bell housing.

Referring to FIGS. 3 and 4, the remote end of the eductor, i.e. port 43, is provided with an intake pipe or fitting 46 to which a flexible hose or conduit 47 is communicated by a circular compartment 48. Hose 47 is of sufficient length to reach into the remotest parts of tank 19 during a desludging or tank cleaning operation. Hose 47 operates under a suction pressure condition and is preferably of sufficient thickness to be structurally sound. Further, hose 47 is also formed of a material adapted to withstand relatively abrasive use either internally or externally due to the passage of sludge therethrough, and manipulation of the hose with the tank 19.

Material found to be appropriate for forming the hose 47 is nylon or similar plastic-like material having a metallic reinforcement element incorporated in the wall thereof. The remote end of the hose 47 is operated at the open position, merely by being inserted into the massive sludge layer and below the surface thereof. If need be hose 47 can be provided with an inlet nozzle adapted to perform a particular function in the tank that would ordinarily be inaccessible to the housing open end.

To facilitate operating the remote end of the hose 47 it can be provided with a handle means to be readily manipulated and adjusted by a worker positioned at the tanker floor so as to guide the hose opening across the floor and remove accumulated sludge deposits.

Other modifications and variations of the invention as hereinbefore set forth may be made without departing from the spirit and scope thereof, and therefore, only such limitations should be imposed as are indicated in the appended claims.

We claim:

1. In a marine vessel having at least one storage tank for holding and transporting liquid cargo, a closed manifold system communicated with said at least one storage tank for transferring said liquid cargo, said system including pumping means which is actuatable to establish a suction condition within the closed manifold system during a cargo offloading operation, and an intake pipe (28) forming an adjunct to said manifold system and being fixedly positioned within said at least one storage tank, said intake pipe (28) having a bell housing including a lip (54), disposed at a position above the tank floor to ingest a flow of liquid cargo during said cargo offloading operation, the improvement therein of portable tank cleaning means for removing sludge and other viscous residue from the floor of said tank subsequent to removal of liquid cargo therefrom, said tank cleaning means comprising;

an elongated flexible conduit (47) having a first end including an eductor (36) which is disconnectably engaged to, and in communication with said intake pipe (28,) said flexible conduit (47) having a remote end which is movable to reach into accumulated sludge at remote sections of the storage tank, said eductor (36) including a clamping surface (53), which extends radially outward therefrom and adapted to engage said lip (54) to form a sealed connection therewith, and clamping means depending from said eductor (36) being actuatable to elevate the eductor (36) whereby to engage the bell housing lip (54) in a sealed tight joint, said clamping means being further adapted to support said eductor (36) above the floor of said storage tank, whereby a suction applied to said closed manifold when said pumping means is actuated, will cause said sludge to be ingested through said flexible conduit 47 and thence removed from the storage tank.

2. In the apparatus as defined in claim 1, wherein said clamping means includes; at least one elongated screw jack (52) depending from said eductor (36) and adapted to rest on the floor of said tank, said screw jack (52) being operable to elevate eductor (36) upwardly from the tank floor and into sealed engagement with said bell housing lip (54).

3. In the apparatus as defined in claim 1, wherein said clamping means includes an elongated handle (63) having a cam-like base (64), said base being pivotally positioned on said eductor (36), said elongated handle being actuatable to engage said cam-like base (64) with the tank floor whereby the elevate the eductor above the floor into sealing relationship with the bell housing lip (54).

* * * * *